US011905072B1

(12) United States Patent
Fischer

(10) Patent No.: US 11,905,072 B1
(45) Date of Patent: Feb. 20, 2024

(54) UNITARY COUPLING ASSEMBLY CLOSURE (CORK-CAP)

(71) Applicant: Lanell Fischer, Van Nuys, CA (US)

(72) Inventor: Lanell Fischer, Van Nuys, CA (US)

( * ) Notice: Subject to any disclaimer, the term of this patent is extended or adjusted under 35 U.S.C. 154(b) by 0 days.

(21) Appl. No.: 17/981,652

(22) Filed: Dec. 8, 2022

(51) Int. Cl.
*B65D 41/04* (2006.01)

(52) U.S. Cl.
CPC ..... *B65D 41/0414* (2013.01)

(58) Field of Classification Search
CPC ..... B65D 41/0414; B65D 41/0457; B65D 47/122; B65D 41/58; B65D 41/04
USPC ..... 215/329, 296, 357, 354; 220/288, 787, 220/789, 801
See application file for complete search history.

(56) References Cited

U.S. PATENT DOCUMENTS 624,384 A * 5/1899 Schroeder ..... B65D 39/16 215/354
657,067 A * 8/1900 Houghton ..... 215/901
705,103 A * 7/1902 Levick ..... A47G 19/26 215/307
1,006,874 A * 10/1911 Presser ..... B65D 49/04 215/26
2,051,310 A * 8/1936 Millard ..... B65D 41/045 215/354
9,365,314 B2 * 6/2016 Smith ..... B65B 43/00

FOREIGN PATENT DOCUMENTS

WO WO2012083368 * 12/2011 ..... B65D 51/18

* cited by examiner

*Primary Examiner* — John K Fristoe, Jr.
*Assistant Examiner* — Elizabeth J Volz

(57) ABSTRACT

The unitary coupling assembly closure of the present invention comprising an inner cork with an outer cylindrical cap body; wherein the inner cork comprises a cork-ring that cover the opening of a container, when the cork-ring center is extended, it becomes the cork-body that fits inside the opening of a container when the unitary coupling assembly closure gets screwed onto the container. This invention allows a container to be uncorked simply by unscrewing the unitary coupling assembly closure and removing it from the opening of the container.

1 Claim, 16 Drawing Sheets

UNITARY COUPLING ASSEMBLY CLOSURE (CORK-CAP)

BACKGROUND OF THE INVENTION

1. Field of the Invention

According to an embodiment of the present invention, the Unitary Coupling Assembly Closure (UCAC), let it be known that the UCAC and Cork-Cap are synonymous and both words are used interchangeably. The Cork-Cap is the coupling together of a cap-body and cork or any substitute that's used in the place of cork; this is a closure for threaded and non-threaded bottles and containers alike, it screws on or off for threaded bottles and containers and for the non-threaded bottles and containers it is pushed in or pulled out.

The embodiment of the Cork-Cap invention pertains to but not limited to being able to offer cork closures in the form of a screw cap. The Cork-Cap is made with and without a crown opening in the cap-body, the one with the opening allows the cork (natural, artificial, man-made) to be exposed to the atmosphere. The Cork-Caps without the crown-openings, but still have cork that fits over or in the orifices of bottles or containers, allows for the Cork-Cap to be easily screwed on or off the threaded bottles or containers and for the non-threaded bottles and containers the Cork-Cap is pushed in or pulled out. The Cork-Cap allows a bottle of wine to be opened (uncorked) or closed (recorked) with the ease of screwing or pulling and pushing. The Cork-Cap closure coupled together two of the most iconic closures in the world, the cork and screw cap, into a single assembled closure.

The problem that the cork community was having had to mainly do with them not being able to open a corked container without an instrumental aid, and the problem within the screw cap community is that most screw caps are not very breathable, and they are made from non-renewable resources.

The major problem that the UCAC invention was able to solve was two-fold in nature; on one hand you have the cork community that always had to use a device to extract the cork out of the bottle or container, and on the other hand you have the screw cap community that enjoys the ease of being able to open their bottles or containers with just a twist of the wrist, so what the UCAC invention did to satisfy both communities was to couple these two closure entities together into a single unitary assembly known as the Cork-Cap. The Cork-Cap does away with needing an instrumental aid to open (uncork) a bottle or container and at the same time the Cork-Cap solves the screw cap problem by making it so that the closure now has all the benefits of a cork and at the same time the ease of a screw cap. The invention of the Cork-Cap reduces that amount of non-renewable resources used in its manufacturing process. Even though in this explanation we are speaking of a "bottle of wine," let it be known that the UCAC also is suited to work with all types of bottles and containers that uses corks and screw caps.

The embodiment of this invention, the Cork-Cap, relates to improving with ease the opening (uncorking) and closing (recorking) of corked or screw cap bottles and containers. The Cork-Cap closure allows for a corked bottle of wine to be opened without the aid of a corkscrew or any other wine bottle cork removing device. The Cork-Cap allows a corked bottle of wine to be opened by simply twisting the Cork-Cap in a counter-clockwise or clockwise direction until it screws off from the sealing surface of the bottle or container, then the Cork-Cap is gently separate from the throat of the wine bottle or container. The Cork-Cap closure reusability allows for a bottle of wine to be closed (recorked) by reinserting the bottom end of the Cork-Cap back into the orifice and down the throat of the bottle or container, then press downward and turning the Cork-Cap in a counter-clockwise or clockwise direction, thus re-sealing the bottle or container of wine, and for bottles and containers without threads the Cork-Cap is simply twisted and pulled out (uncorked) when opening and pushed in (recorking) when closing.

With the embodiment of the Cork-Cap solving the problem of being able to remove a cork from a wine bottle or container with ease and without the aid of a corkscrew or any other cork removing device that is used for removing corks from wine bottles or containers. The Cork-Cap also solves the problem of being able to re-insert the cork back into a wine bottle or container without and aid once the cork has been removed. Another benefit of the Cork-Cap is that it offers the ease of opening and closing by having screw-on, screw-off, pull-out and push-in capabilities. In the examples that reference the Cork-Cap, let it be known that the cork associated with the Cork-Cap covers all substances that are natural, artificial, man-made, or any other substance that can be used or substituted in place of cork.

2. Description of Related Art

Corks have been used as closures for centuries, they were the go-to for closures for sealing bottles as well as containers, and then the screw-on cap was introduced. Separately, they both offers benefits; the problem is that neither one of them alone was able to satisfy the other's short comings, Now enters the Unitary Coupling Assembly Closure that complements, strengthens, and form a unique and new innovative invention: the Cork-Cap, this invention addresses the problem of being able to open a corked bottle or container without the aid of a cork extraction device.

The Cork-Cap was able to integrate two separately functioning closure entities into a single Unitary Coupling Assembly Closure. This invention allows a cork and a screw cap to be assembled and coupled together as a single functioning closure: the Cork-Cap. This invention allows the ease of being able to still have a bottle or container corked but only now you also have the ease of being able to screw your cork out of the bottle or container instead of having to use a cork extracting device, you will now also be able to close (recork) your bottle or container with the same ease that you used during the opening (uncorking) process. The Cork-Cap eliminates the hassle of putting the cork back into the bottle or container. The Cork-cap is truly an inexpensive solution to an age old problem of being able to extract a cork from a bottle or contain and then being able to reinsert it back into the bottle or container hassle free. The Cork-Cap allows you to not only extract the cork out of the bottle or container, but it also allows you to re-insert the cork back into the bottle or container with the same ease used for its removal. This invention offers an individuality and uniqueness that is only exclusive to the Unitary Coupling Assembly Closure.

BRIEF SUMMARY

The present invention, Cork-Cap, is a closure that offers the advantage of being able to do something that has never been done before in the world of closures and that is being able to unite both the cork and screw cap communities together. This invention offers ease of use, uniqueness, simplicity, and affordability. The Cork-Cap now allows for the cork or any substance that is used in place of cork, artificial or manmade, to be easily removed from a bottle or container by screwing the Cork-Cap off, and the Cork-Cap is just as easily re-inserted back into a bottle or container simply by screwing the Cork-Cap on. The ease and simplicity of the Cork-Cap closure works just as well on threadless bottles and containers as well because the Cork-Cap also comes without threads, see FIGS. 8 and 17; this allows the bottle or container to be opened simply by twisting the Cork-Cap and pulling it out of the bottle or container, and when closing the bottle or container you just simply push the cork-body of the Cork-Cap back into the orifice of the bottle or container. There is also a Cork-Cap with a closed-opening, it is exactly like the Cork-Cap with the crown-opening, except that it does not have a crown opening.

The affordability of the Cork-Cap is in the same price range as many of the other alternative closures that are already on the market, and the simplicity of the Cork-Cap is possible because it allows a bottle or container to be opened (uncorked) and closed (recorked) with just a twist of the wrist. The cork community will still be able to have their bottles and containers corked and the screw cap community will still be able to have the ease of being able to screw open their bottles and containers.

BRIEF DESCRIPTION OF THE DRAWINGS

Various other objects, features and attendant advantages of the present invention will become fully appreciated as the same become better understood when considered in conjunction with the accompanying drawings, in which like reference characters designate the same or similar parts throughout the several views, and wherein.

REFERENCE NUMBERS IN FIGURES

5 Cork-Cap
5A cap-body
5B neck-cap space
5D cork-body
5D crown-opening
5E cork
5F mouth
5G closure-skirt
5H tamper-evident bridges
5J knurl
5K closed-opening
5L top-seal
10 cork-head
10A cork-tip
10B cork-ring
10C cork-sealing surface
10D cork-sealing groove
10E cork-head extension
10G cork-ring center
15 top-cap rim
15A bottom-cap rim
20 continuous-threads
25 bottleneck
25A inside bottleneck
25B bottle-sealing surface
25C bottle-threads
25D orifice
25E cap-body cavity
25F threadless-bottleneck

DETAILED DESCRIPTION OF THE INVENTION

Before any embodiments of the invention are explained in detail, it is to be understood that the invention is not limited in its application to the details of construction and the arrangement of components set forth in the following description or illustrated in the following drawings. Also, it is to be understood that the phraseology and terminology used herein is for the purpose of description and should not be regarded as limiting. And let it be known that this invention the Unitary Coupling Assembly Closure (Cork-Cap), that the word substance, which is anything that can be substituted in place of cork, and cork are synonymous and both words are used interchangeably.

Figure 1:
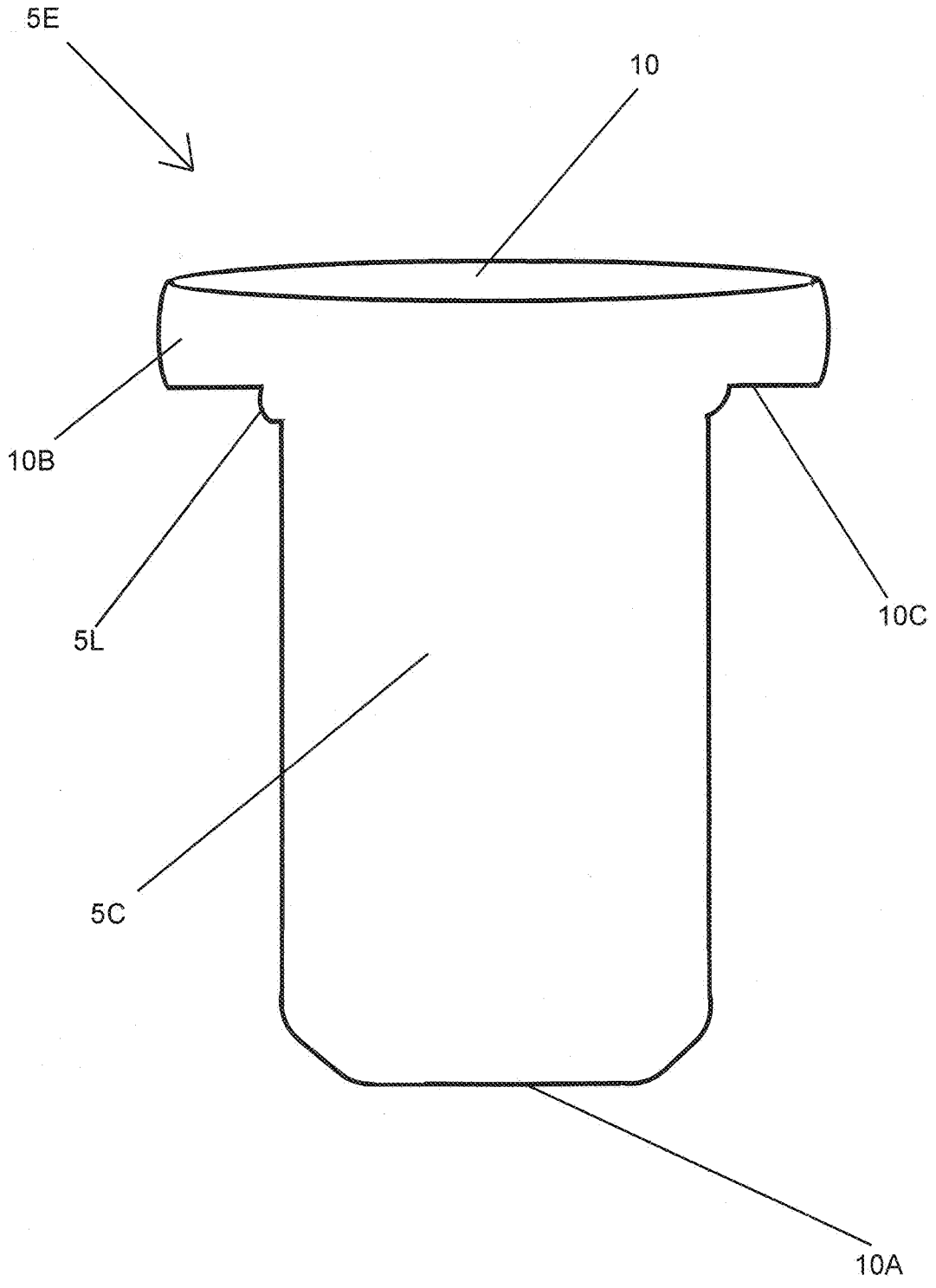
FIG. 1 is a view of a cork-body 5C, cork 5E, top-seal 5L, cork-head 10, cork-tip 10A, cork-ring 10B and cork-sealing surface 10C.

FIG. 1 is an example and an embodiment of a cork 5E consisting of but not limited to a cork-body 5C, cork-head 10, top-seal 5L, cork-tip 10A, cork-ring 10B, and there is the cork-head extension 10E, see FIGS. 7, 8, 9 and 10. A cork-body 5C is the extension of the cork-ring center 10G and it is this extension of the cork 5E that gets inserted into the bottleneck 25 or container, see FIGS. 4 and 8; the cork-tip 10A help guide the cork-body 5C into the orifice 25D of a bottle or container. On the underside of the cork-ring 10B is the cork-sealing surface 10C, see FIGS. 1, 4, 5A, 13A, 15A, 15B, 16A and 16B and the cork-sealing groove 10D, see FIGS. 14B and 17; aside from the cork-ring 10B being a part of the cork 5E, it also acts as a stand-alone unit, see FIGS. 11, 13A, 13B, 14A, 14B, 15A, 15B, 16A and 16B, this is the cork that gets coupled to the cap-body 5A, see FIG. 12. The cork-heads 10 are exposed to the atmosphere, this allows a small amount of air to circulate in and out of the bottle or container, the Cork-Cap 5 that do not have an exposed cork-head 10 is the one with the closed-opening 5K. The top-seal 5L is a section of the cork 5E that forms an even tighter seal just inside the orifice 25D of a bottle or container once the Cork-Cap 5 is inserted. Let it be known that all manners of cork 5E and cork substitutes mentioned have an implied cork-head 10 rather they are mentioned or not.

Figure 2:
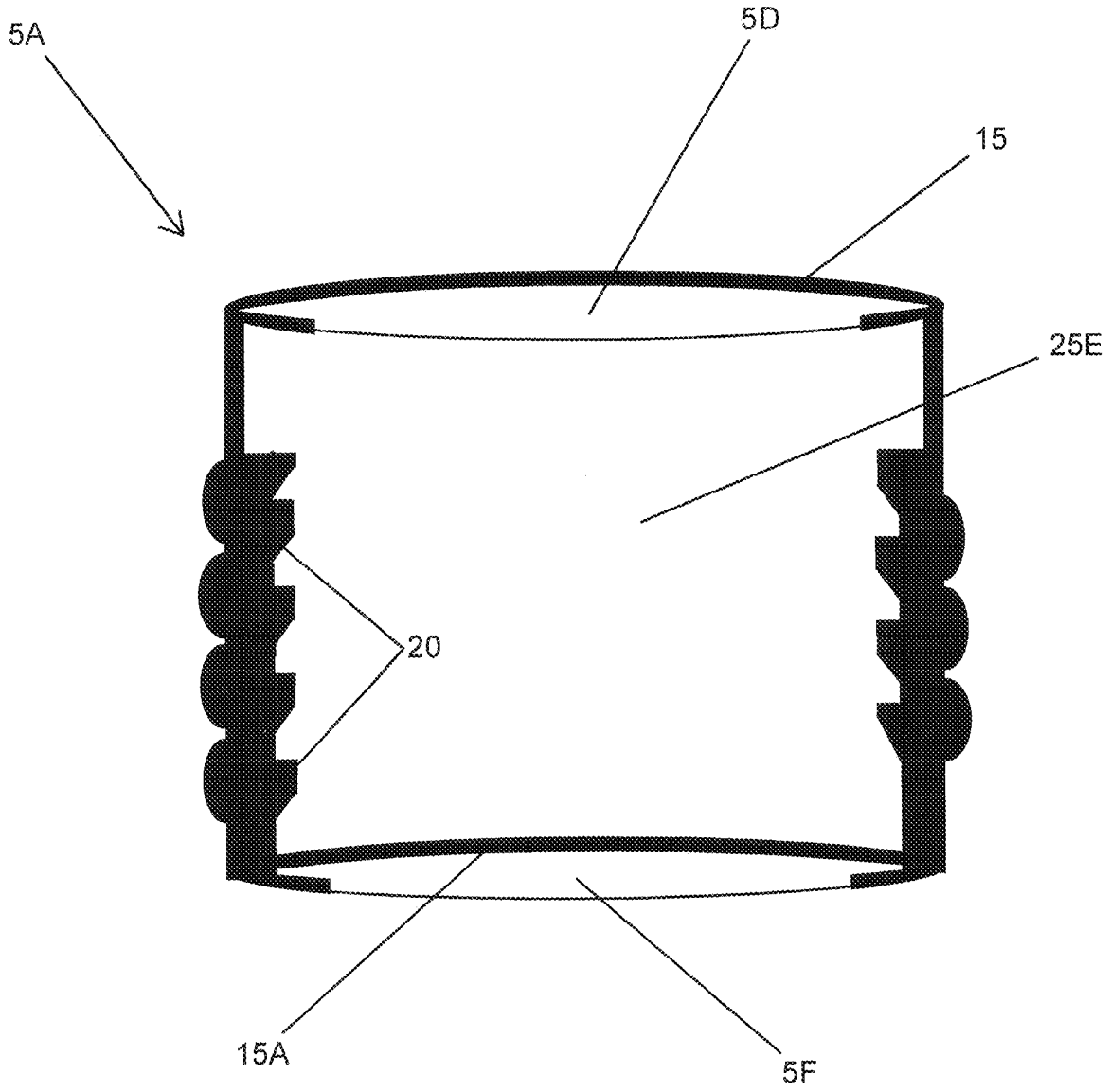
FIG. 2 is a view of a cap-body 5A, crown-opening 5D, mouth 5F, top-cap rim 15, bottom-cap rim 15A, continuous-threads 20 and cap-body cavity 25E.
Figure 5A:
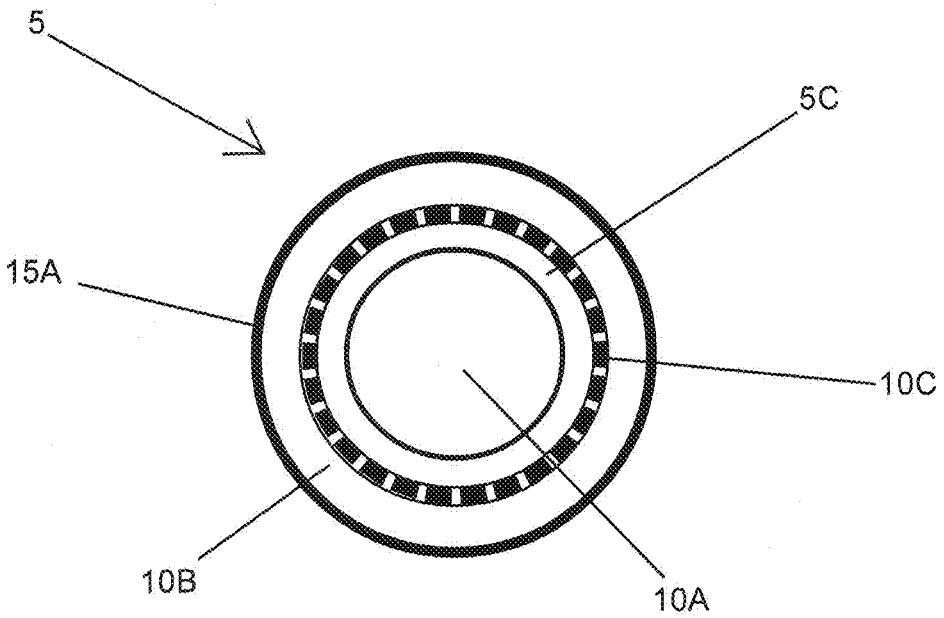
FIG. 5A is a bottom view of a Cork-Cap 5, cork-body 5C, cork-tip 10A, cork-ring 10B, cork-sealing surface 10C and bottom-cap rim 15A.
Figure 5B:
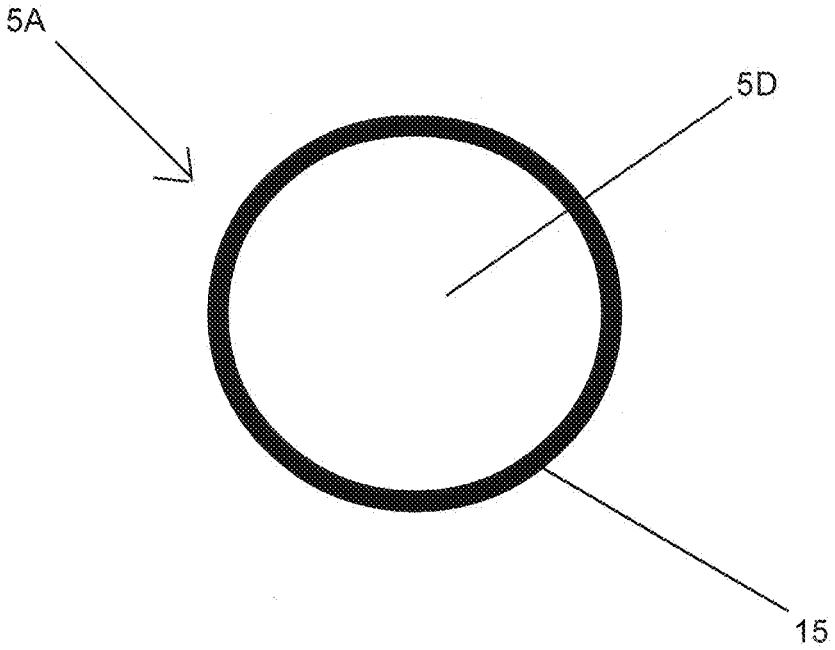
FIG. 5B is a top view of a cap-body 5A, crown-opening 5D and top-cap rim 15.
Figure 10:
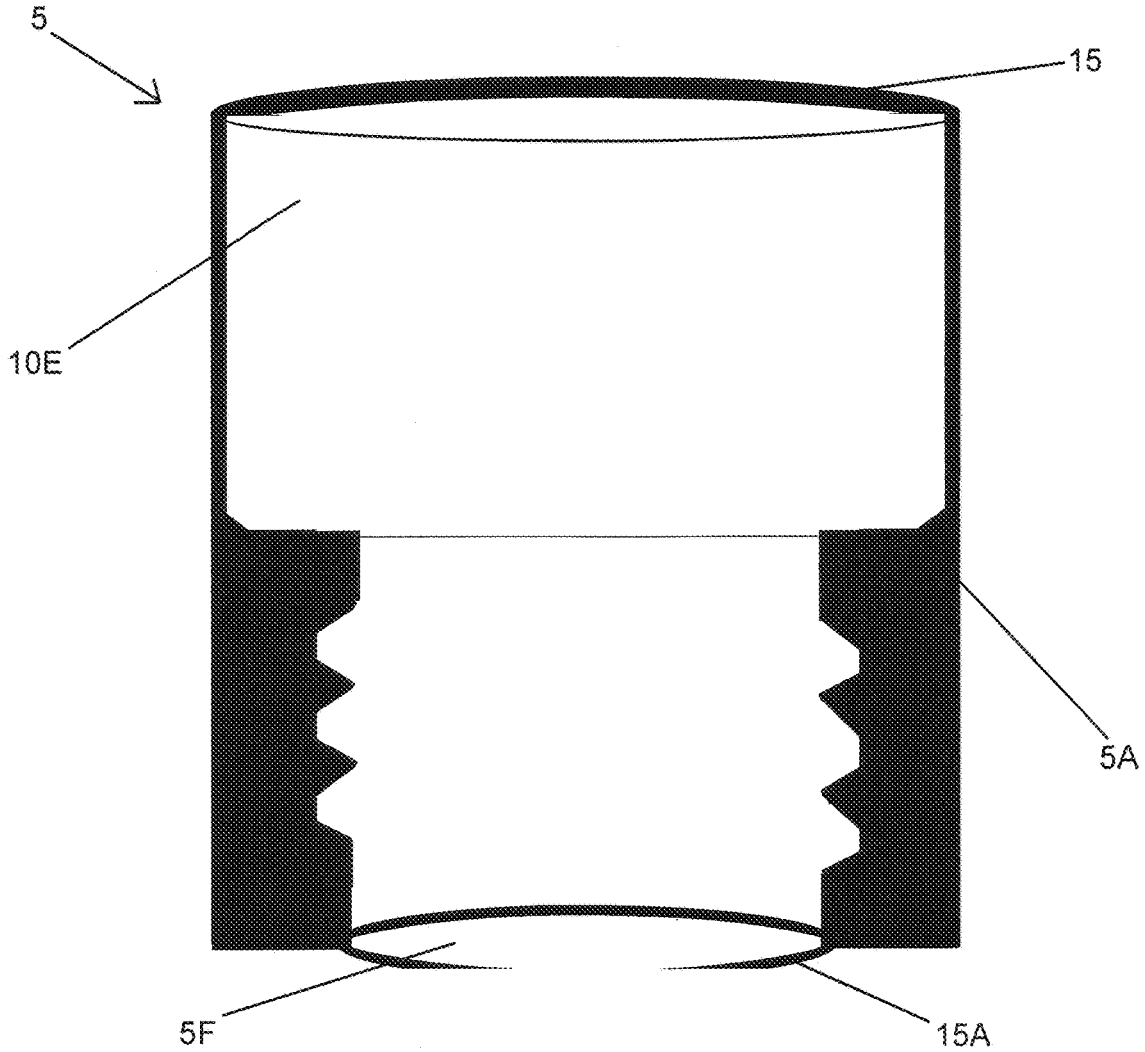
FIG. 10 is a view of a Cork-Cap 5, cap-body 5A, mouth 5F, cork-head extension 10E, top-cap rim 15 and bottom-cap rim 15A.
Figure 12:
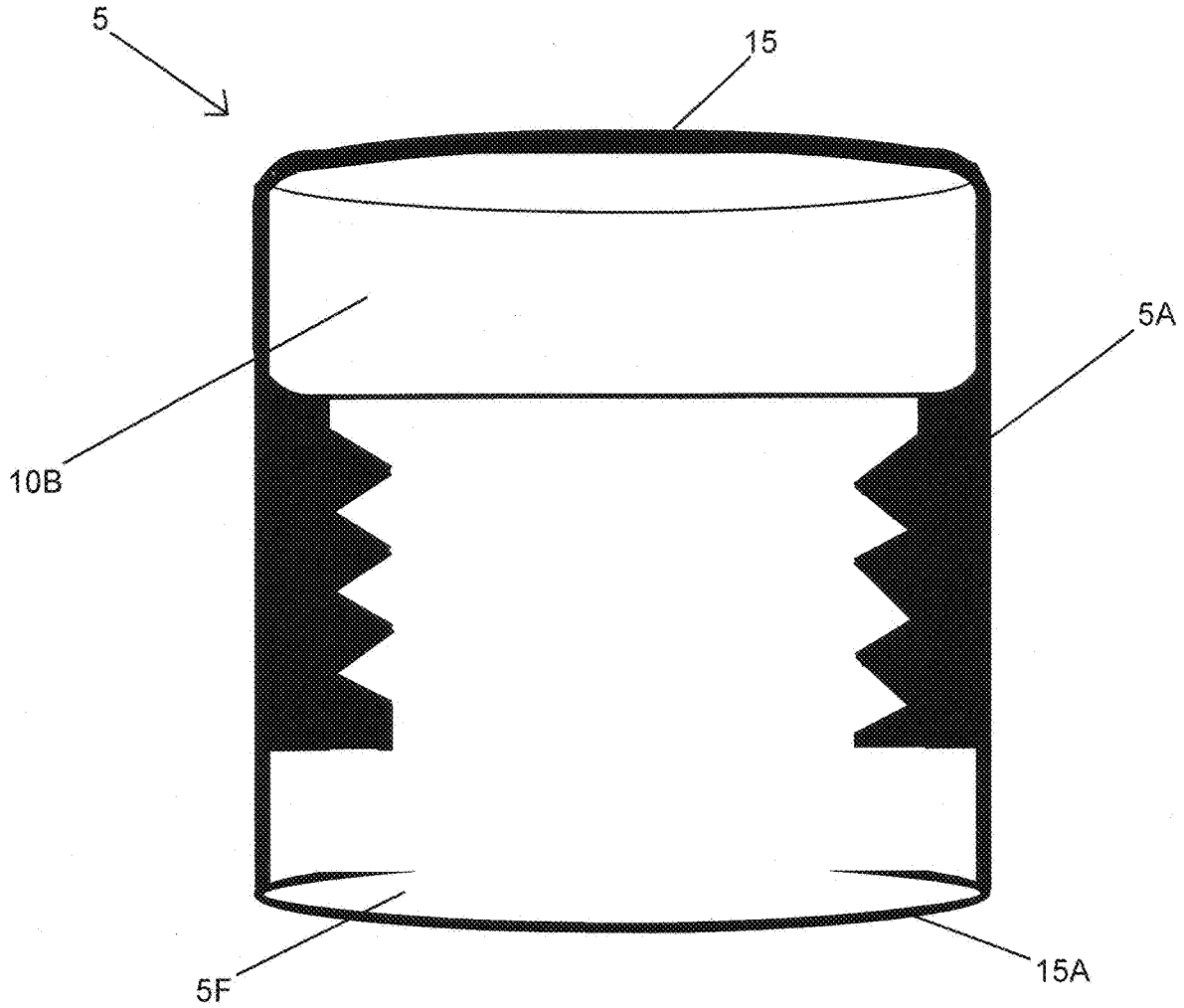
FIG. 12 is a view of a Cork-Cap 5, cap-body 5A, mouth 5F, cork-ring 10B, top-cap rim 15 and bottom-cap rim 15A.
Figure 18:
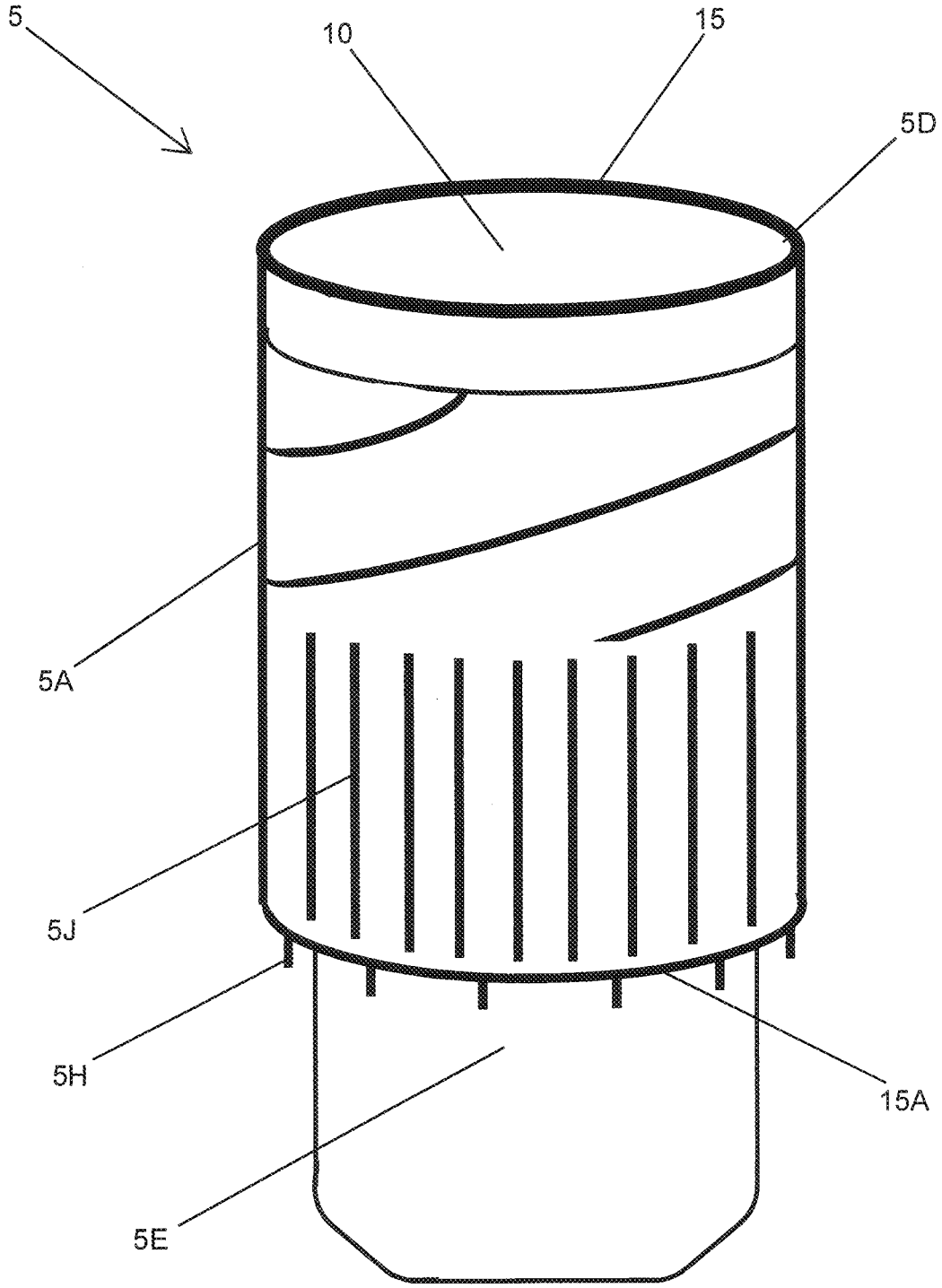
FIG. 18 is a view of a Cork-Cap 5, cap-body 5A, crown-opening 5D, cork 5E, tamper-evident bridges 5H, knurls 5J, cork-head 10, top-cap rim 15 and bottom-cap rim 15A.
Figure 19:
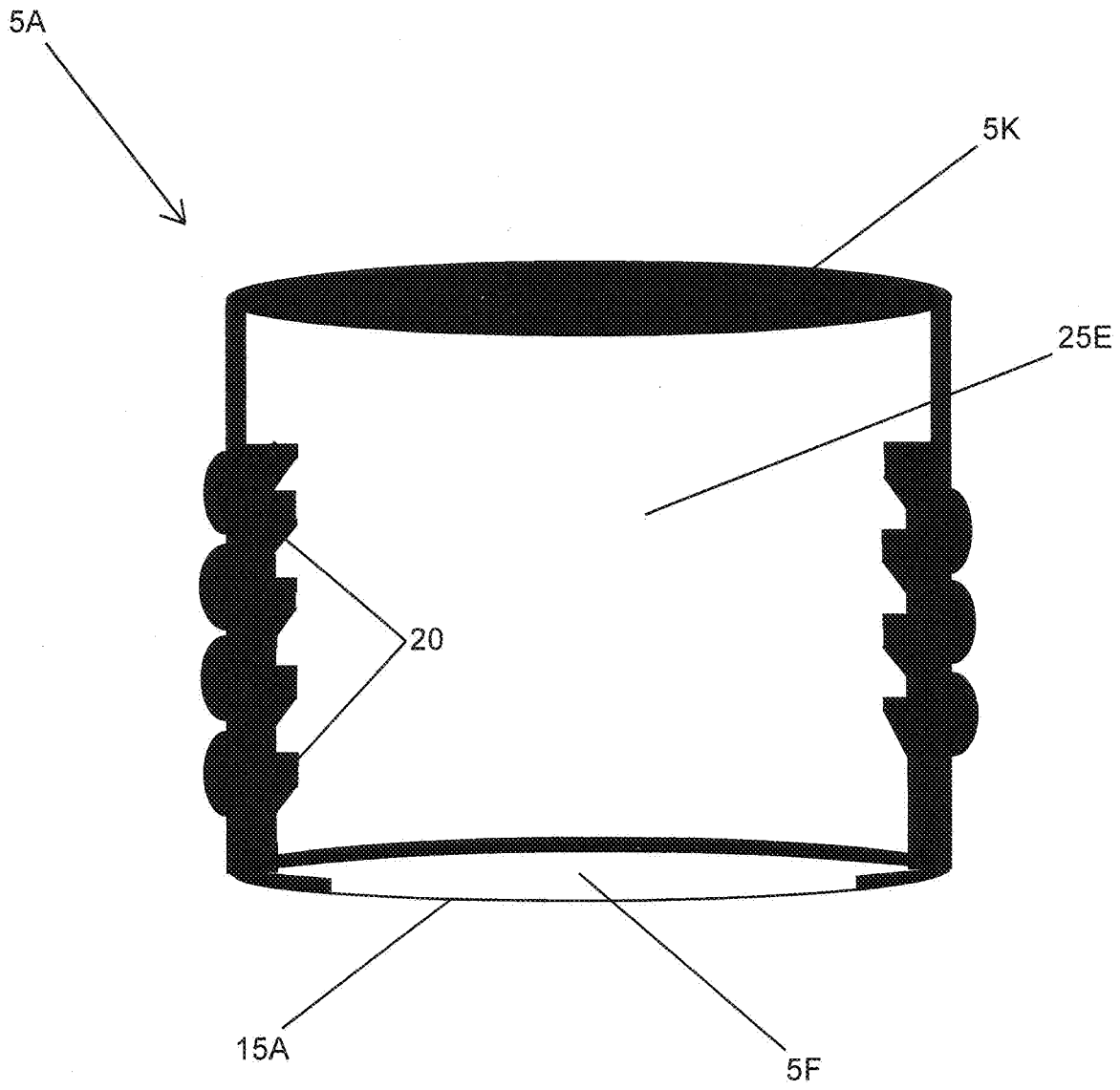
FIG. 19 is a view of a cap-body 5A, mouth 5F, closed-opening 5K, bottom-cap rim 15A, continuous-threads 20 and cap-body cavity 25E.

FIG. 2 is an example and an embodiment of a cap-body 5A that is cylindrical with a top-cap rim 15 that defines the circumference of the crown-opening 5D, see FIGS. 5B and 18, this is the area of the cap-body 5C that defines the crown-opening 5D where the cork-heads 10 are exposed to the atmosphere; the bottom-cap rim 15A creates the mouth 5F of the cap-body 5A, see FIGS. 10, 12 and 19; the mouth 5F fits over a bottle-sealing surface 25B and orifice 25D of a bottle or container. All the Cork-Caps 5 have a mouth 5F.

Figure 3:
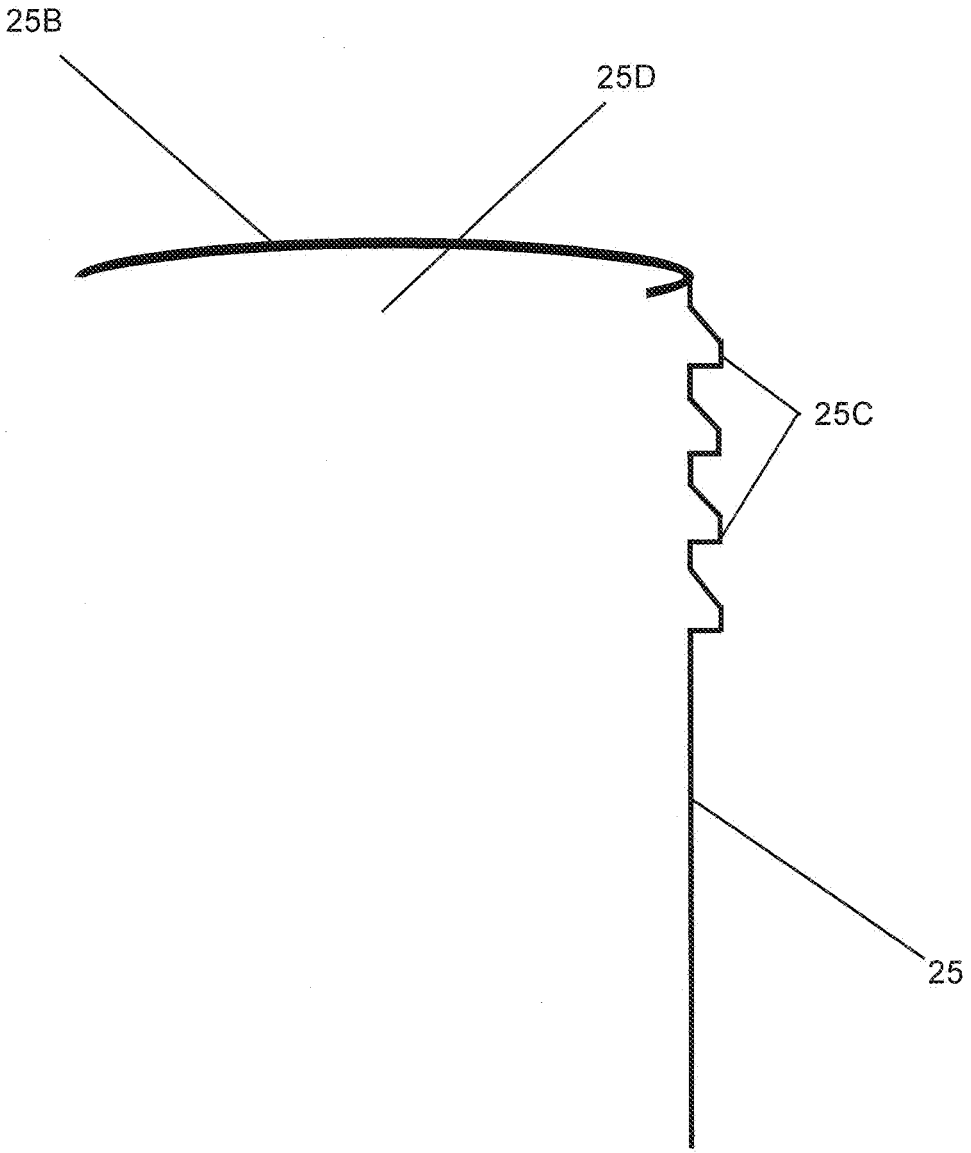
FIG. 3 is a view of a sliced section of a bottleneck 25, bottle-sealing surface 25B, bottle-threads 25C and orifice 25D.

FIG. 3 is an embodiment of a sliced bottleneck 25 showing the orifice 25D where the cork-body 5C gets inserted or a cork-ring 10B covers it; the bottle-threads 25C located at the top section of the bottleneck 25 is where the continuous-threads 20 of a cap-body 5A is screw off or on when uncorking or recorking a bottle or container. The bottle-sealing surface 25B forms a seal with the cork-sealing surfaces 10C or the cork-sealing grooved surfaces 10D, see FIGS. 4 and 8.

Figure 4:
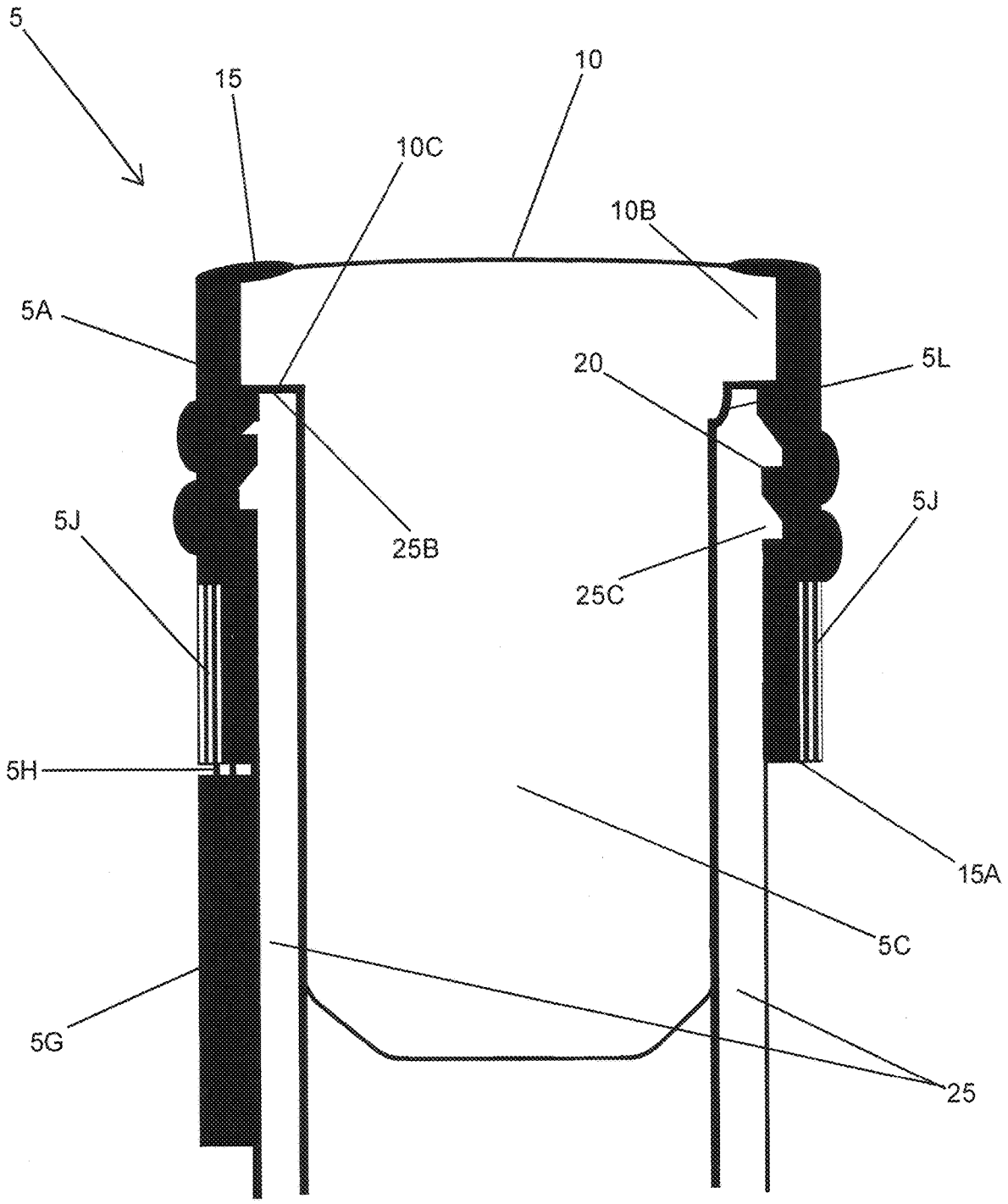
FIG. 4 s a view of a Cork-Cap 5, cap-body 5A, cork-body 5C, closure-skirt 5G, tamper-evident bridges 5H, knurls 5J, top-seal 5L, cork-head 10, cork-ring 10B, cork-sealing surface 10C, top-cap rim 15, bottom-cap rim 15A, continuous-threads 20, bottleneck 25, bottle-sealing surface 25B and bottle-threads 25C.

FIG. 4 is an example and an embodiment of a sliced section of a Cork-Cap 5 screwed onto a bottleneck 25, showing how the continuous-threads 20 are screwed onto the bottle-threads 25C with the cork-body 5C inserted into the bottleneck 25 where the cork-sealing surface 10C forms a seal with the bottle-sealing surface 25B and the top-seal 5L forms a tighter seal just below the orifice 25D. In this illustration the cork-ring 10B is firmly joined to the inside of the cap-body 5A, see FIGS. 8, 10, 12 and 17. The closure-skid 5G is on the vertical wall of the bottleneck 25 and its connected to the bottom-cap rim 15A by the tamper-evident bridges 5H; the tamper-evident bridges 5H serves as a tamper-evidence indicator and they are designed to break apart once the Cork-Cap 5 is twisted. If the tamper-evident bridges 5H are broken it's an indication that the bottle or container has been opened, if the tamper-evident bridges 5H are not broken it's an indicator that the bottle or container has not been opened. The cork-head 10 is exposed to the atmosphere so that small amounts of air can circulate in and out of the bottle or container. The knurls 5J are used as a gripping area that helps in preventing slippage when gripping and removing a Cork-Cap 5. The top-seal 5L is present on the right side of FIG. 4 but absent on the left side of FIG. 4, this is so that the cork-sealing surface 10C and the bottle-sealing surface 25B can be better displayed. Let it be known and without limitations that other substances such as artificial or man-made substances can be used in place of cork 5.

FIG. 5A is an example and an embodiment of a Cork-Cap 5 showing a bottom view; the cork-ring 10B can be seen with the cork-sealing surface 10C that forms a seal with a container or bottle-sealing surface 25B, it also shows the bottom-cap rim 15A that forms the mouth 5F of the Cork-Cap 5.

FIG. 5B is an example and an embodiment of a cap-body 5A showing the crown-opening 5D and the top-cap rim 15 which is responsible for adding downward pressure onto the cork-ring 10B, this aids in the sealing process; the top-cap rim 15 also serves as the circumference of the crown-opening 5D.

Figure 6:
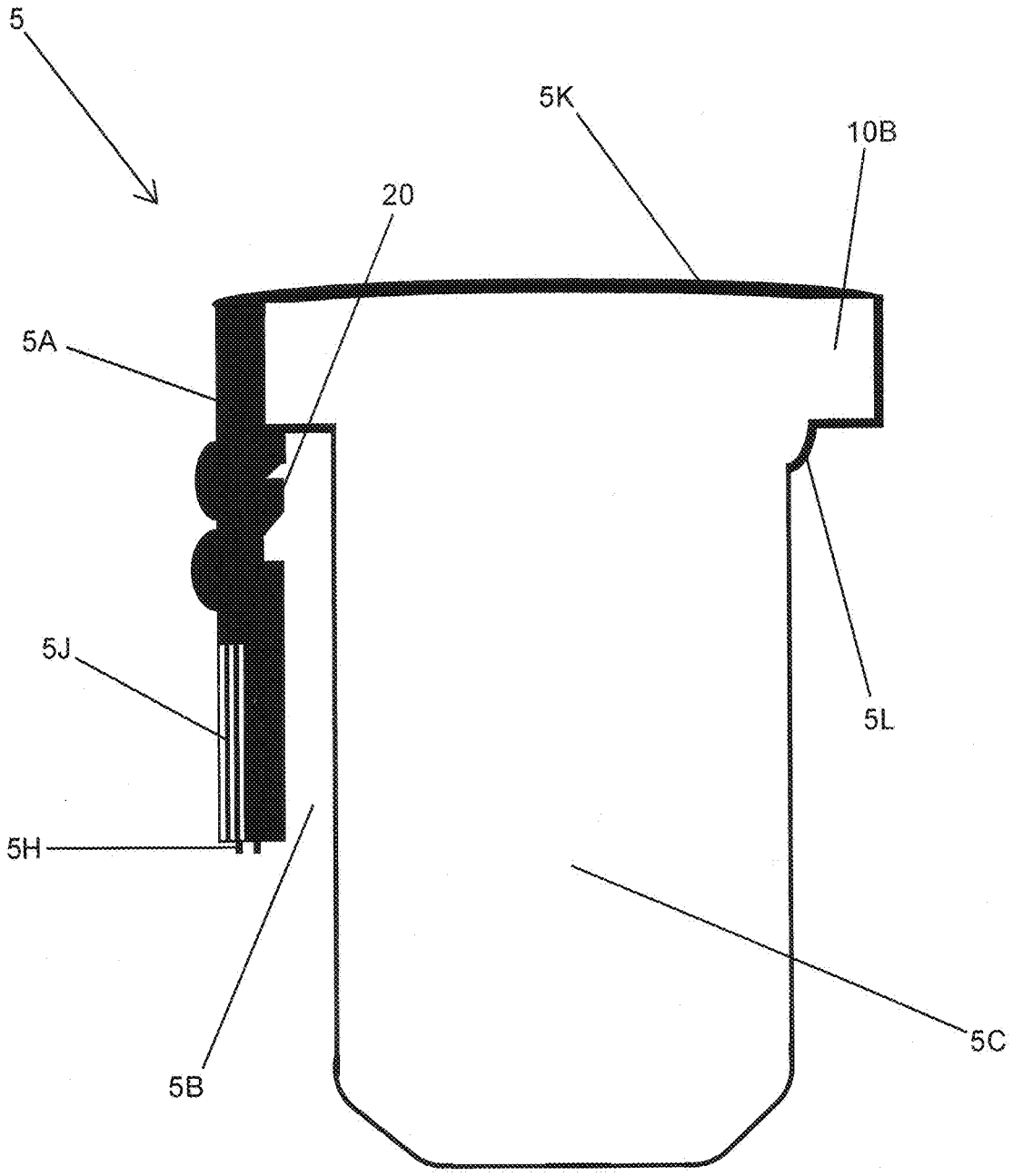
FIG. 6 is a view of a Cork-Cap 5, cap-body 5A, neck-cap space 5B, cork-body 5C, tamper-evident bridges 5H, knurls 5J, closed-opening 5K, top-seal 5L, cork-ring 10B and continuous-threads 20.

FIG. 6 is an example and an embodiment of a Cork-Cap 5 showing the right side with the top-seal 5L while the left side does not show the top-seal 5L, this is done so that a better view of the top-seal 5L can be seen. Let it be known that the top-seal 5L goes completely around the circumference of the cork 5E.

Figure 7:
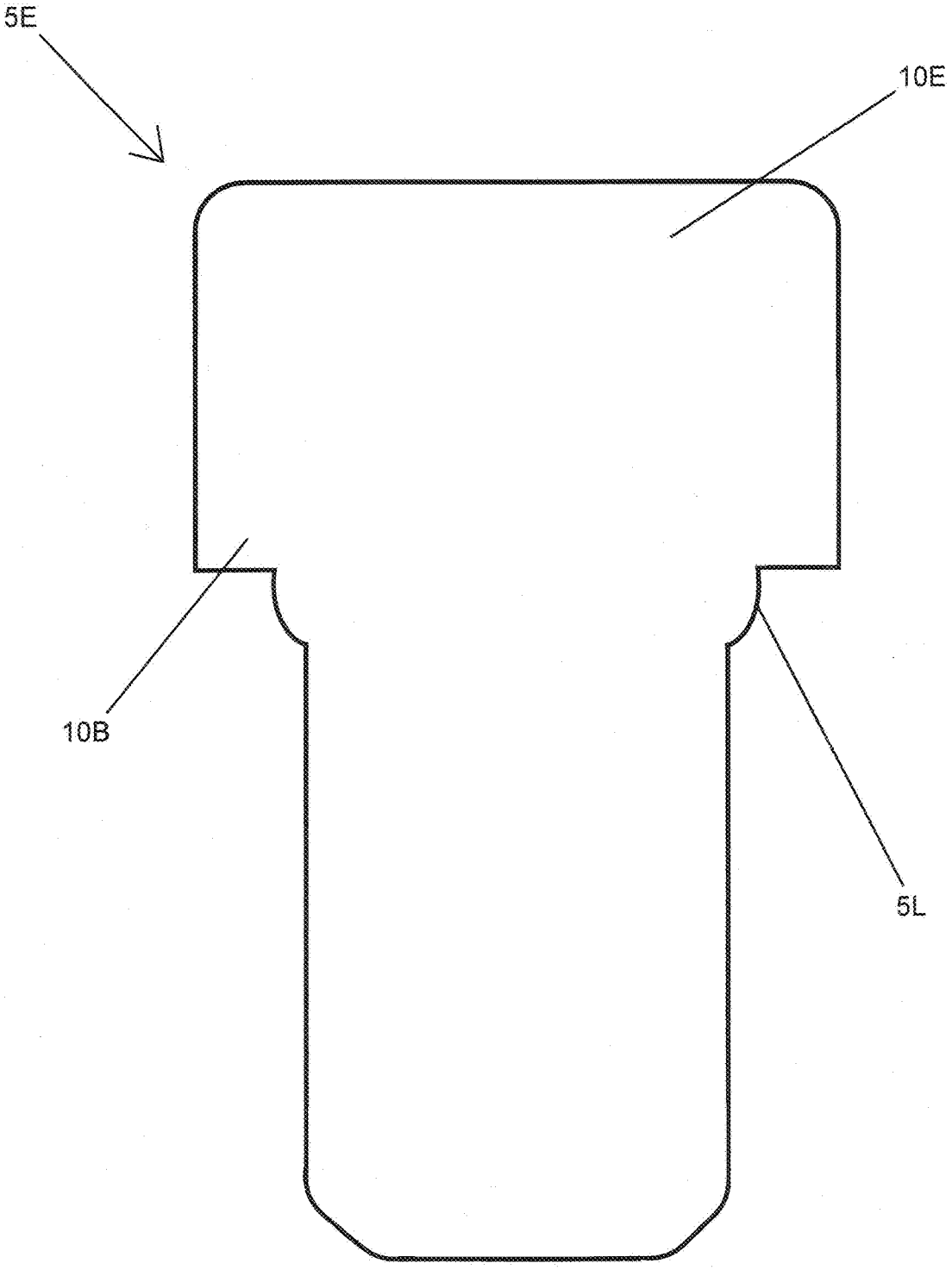
FIG. 7 is a view of a cork 5E, top-seal 5L, cork-ring 10B and cork-head extension 10E.
Figure 8:
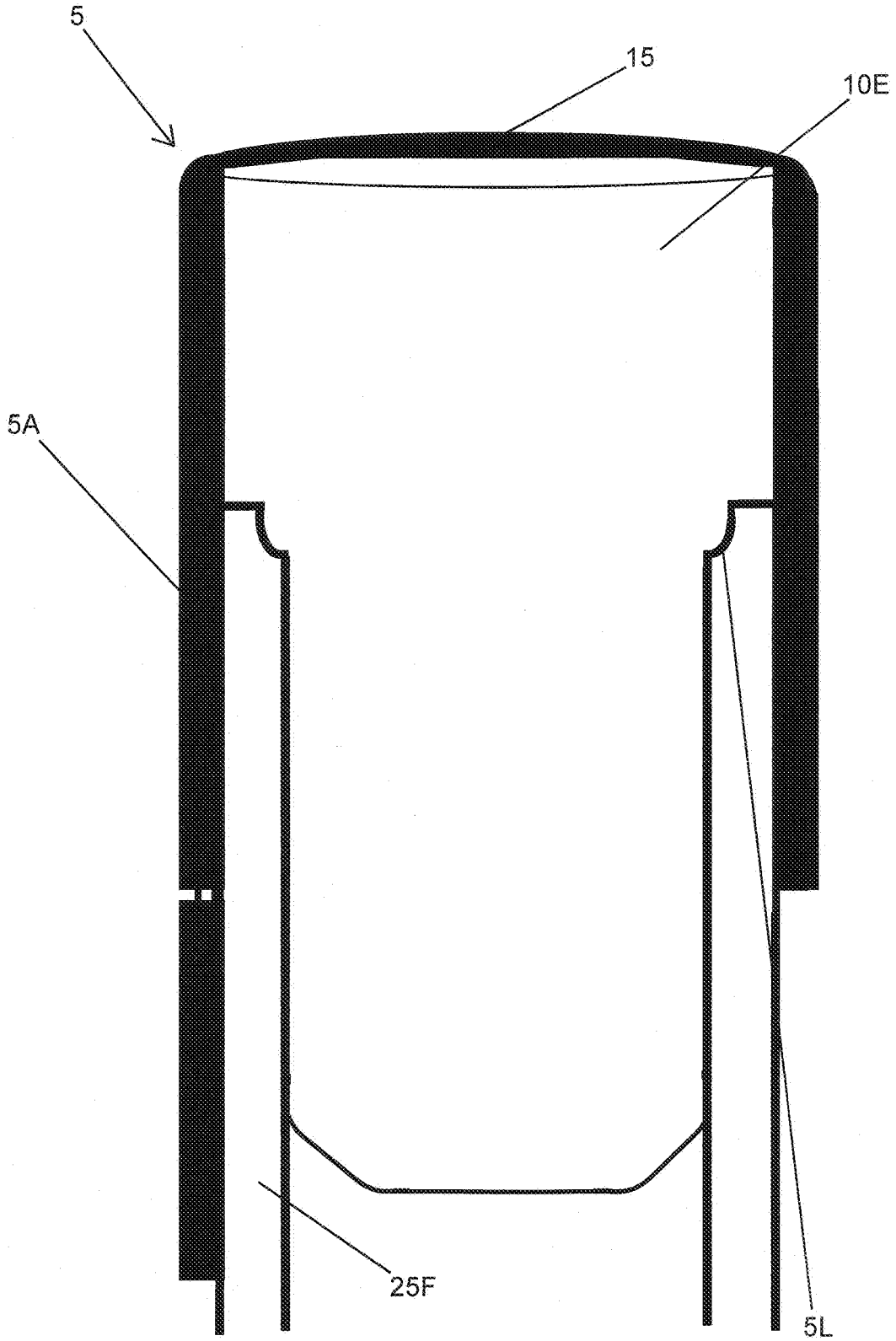
FIG. 8 is a view of a Cork-Cap 5, cap-body 5A, top-seal 5L, cork-head extension 10E, top-cap rim 15 and a threadless-bottleneck 25F.

FIG. 7 is an example and an embodiment of a cork 5E with a cork-head extension 10E, The cork-head extension 10E allows a greater amount of cork to be above the cork-ring 10B, see FIGS. 8, and 10. The top-seal 5L is also present.

FIG. 8 is an example and an embodiment of a Cork-Cap 5, showing how a cork 5E with a cork-head extension 10E is inserted into a threadless-bottleneck 25F. To uncork the Cork-Cap 5 from a threadless-bottleneck 25F or container, all is needed is a twisting of the Cork-Cap 5, this will break the tamper-evident bridges 5H; continual twisting and pulling at the same time will allow the Cork-Cap 5 to be removed from the bottle or container; to recork the bottle or container you just aline the cork-tip 10A over the orifice 25D of the bottle or container and push the Cork-Cap 5 in. The top-cap rim 15 adds a downward pressure on the cork-head 10 when the Cork-Cap 5 is inserted into a bottle or container causing the top-seal 5L to form an even tighter seal just below the orifice 25D, normally the top-seal 5L would not be seen once it is inserted into a bottle or container but for demonstrative purposes it is shown.

Figure 9:
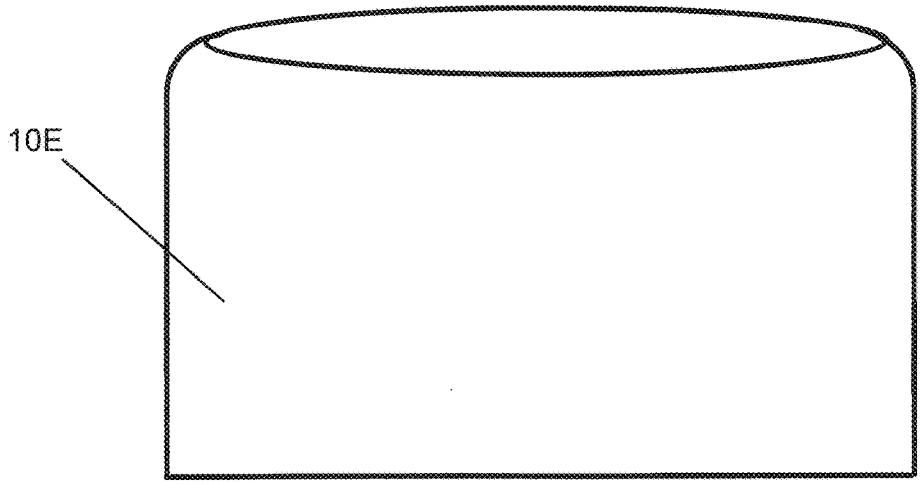
FIG. 9 is a view of a cork-head extension 10E.

FIG. 9 is an example and an embodiment of a cork-head extension 10E without a cork-body 5C.

FIG. 10 is an example and an embodiment of a Cork-Cap 5 showing how a cork-head extension 10E is situated when it is coupled to a cap-body 5A and it also shows the top-cap rim 15 as well as the bottom-cap rim 15A that forms the mouth 5F of the Cork-Cap 5.

Figure 11:
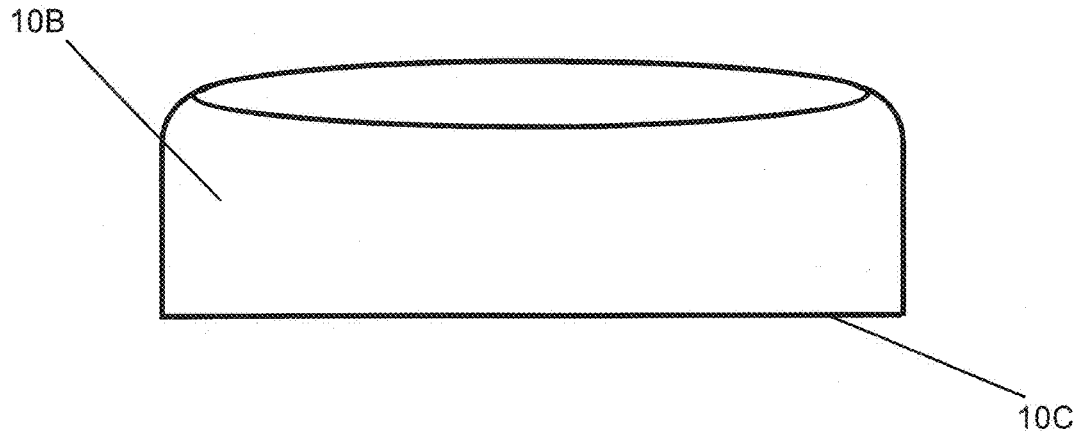
FIG. 11 is a front view of a cork-ring 10B and cork-sealing surface 10C.

FIG. 11 is an example and an embodiment of a cork-ring 10B without a cork-body 5C, it has a cork-sealing flat surface 10C that fits directly onto the bottle-sealing surface 25B of a bottle or container.

FIG. 12 is an example and an embodiment of a Cork-Cap 5 showing a cork-ring 10B coupled to a cap-body 5A, it also shows the top-cap rim 15 as well as the bottom-cap rim 15A that forms the mouth 5F of the cap-body 5A.

Figure 13A:
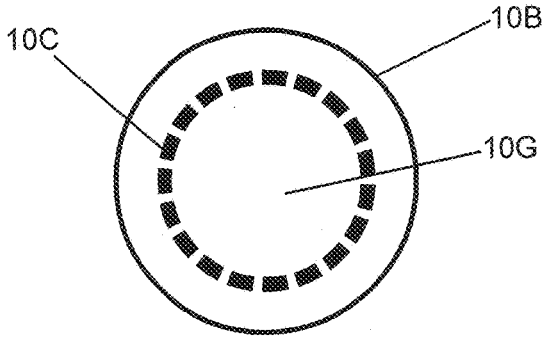
FIG. 13A is a bottom view of cork-ring 10B, cork-sealing surface 10C and cork-ring center 10G.

FIG. 13A is an example and an embodiment showing a bottom view for one of the different versions of the cork-rings 10B; this is a flat version showing the cork-sealing surface 10C with the cork-ring center 10G that gets pressed down over the orifice of a bottle or container.

Figure 13B:
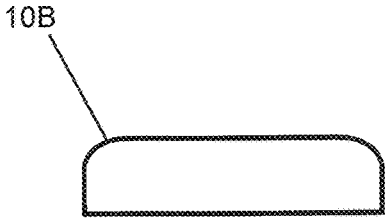
FIG. 13B is a front view of a cork-ring 10B.

FIG. 13B is an example and an embodiment of a front view of a cork-ring 10B, FIG. 12 shows how it looks when it's coupled to a cap-body 5A.

Figure 14A:
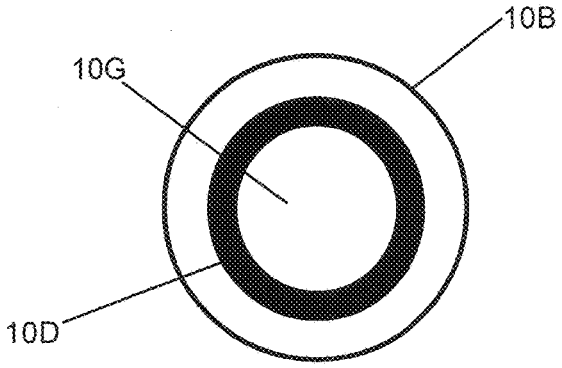
FIG. 14A is a bottom view of cork-ring 10B, cork-sealing groove 10D and cork-ring center 10G.

FIG. 14A is an example and an embodiment showing a bottom view for one of the cork-ring 10B, this version has the cork-sealing groove 10D that fits tightly onto the bottle-sealing surface 25B where it forms a tight seal, the cork-ring center 10G is situated just inside the orifice 25D of a bottle or container where it forms a tight seal.

Figure 14B:
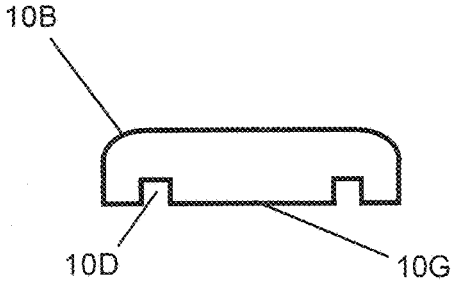
FIG. 14B is a front view of a cork-ring 10B, cork-sealing groove 10D and cork-ring center 10G.

FIG. 14B is an example and an embodiment of a front view of a cork-ring 10B showing the cork-sealing grooves 10D that fit onto the bottle-sealing surface 25B with the cork-ring center 10G that fits tightly inside the orifice 25D of a bottle or container.

Figure 15A:
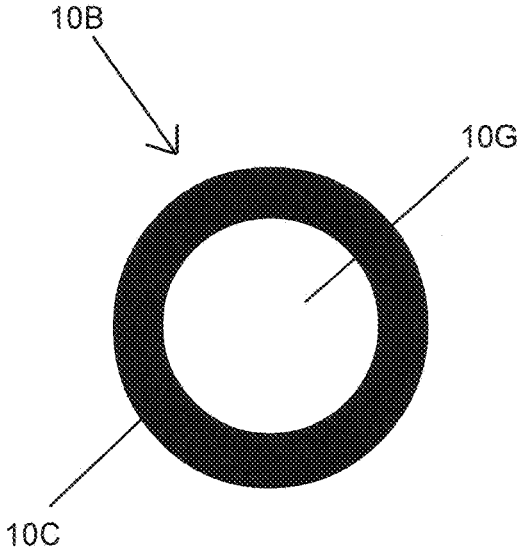
FIG. 15A is a bottom view of a cork-ring 10B, cork-sealing surface 10C and cork-ring center 10G.

FIG. 15A is an example and an embodiment showing a bottom view of a cork-ring 10B with the cork-sealing surface 10C that forms a seal against the bottle-sealing surface 25B of a bottle or container while the cork-ring center 10G forms a seal in the orifice 25D of a bottle or container.

Figure 15B:
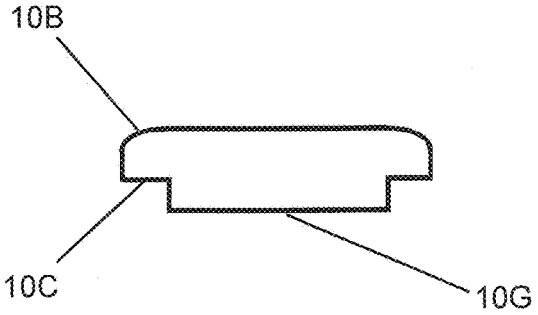
FIG. 15B is a front view of a cork-ring 10B, cork-sealing surface 10C and cork-ring center 10G.

FIG. 15B is an example and an embodiment of a front view of a cork-ring 10B showing the cork-sealing flat surface 10C that seals the top bottle-sealing surface 25B of a bottle or container, the cork-ring center 10G will be inserted into the orifice 25D of a bottle or container where it forms a tight seal.

Figure 16A:
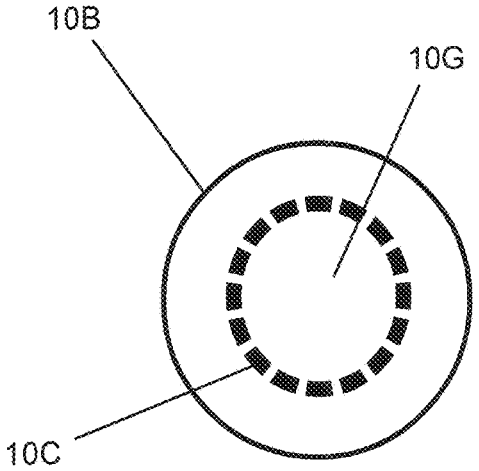
FIG. 16A is a bottom view of a cork-ring 10B, cork-sealing surface 10C and cork-ring center 10G.

FIG. 16A is an example and an embodiment showing a bottom view of a cork-ring 10B with the cork-sealing flat surface 10C that seals the top bottle-sealing surface 25B while the cork-ring canter 10G gets seated over the orifice 25D of a bottle or container.

Figure 16B:
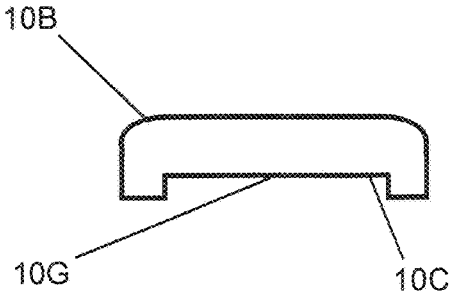
FIG. 16B is a front view of a cork-ring 10B, cork-sealing surface 10C and cork-ring center 10G.

FIG. 16B is an example and an embodiment of a front view of a cork-ring 10B that shows the cork-ring center 10G and the cork-sealing flat surface 10C. It also shows that the cork-ring center 10G and the cork-sealing flat surface 10C are both slightly sunk into the bottom of the cork-ring 10B. The cork-ring 10B coupled to a cap-body 5A forms a Cork-Cap 5, see FIG. 12.

Figure 17:
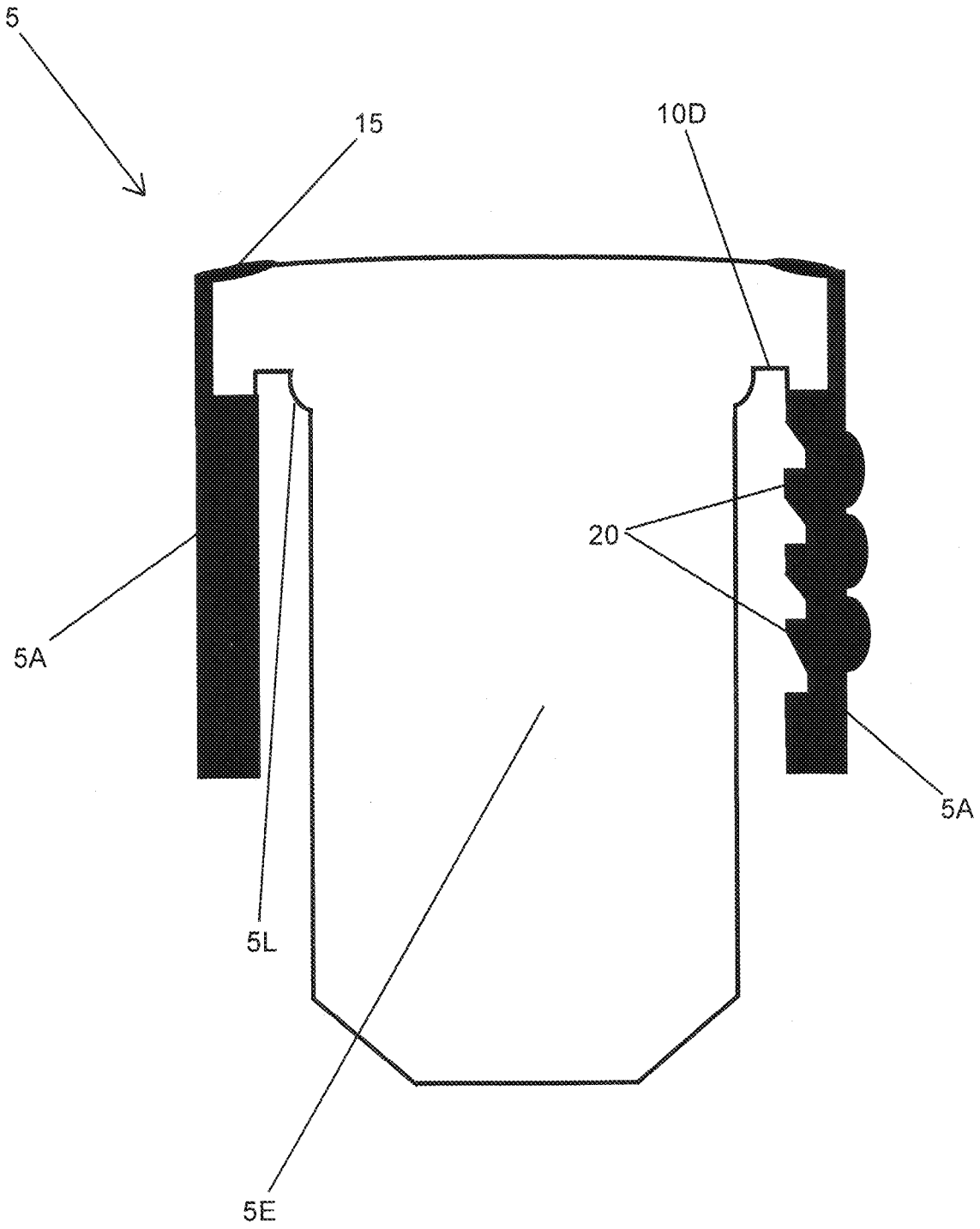
FIG. 17 is a view of a Cork-Cap 5, cap-body 5A, top-seal 5L, cork-sealing surface 10C, cork-sealing groove 10D, cork 5E, top-cap rim 15 and continuous-threads 20.

FIG. 17 is an example and an embodiment of a Cork-Cap 5 having two different sides: the left side, without the continuous-threads 20, shows how the Cork-Cap 5 looks when it is used on a threadless bottle or container and the right side, with continuous-threads 20, shows how the Cork-Cap 5 looks when it is used on a threaded bottle or container. In this illustration the cork-sealing grooves 10D are shown, this is where the bottle-sealing surface 25B, of a bottle or container, fits when the Cork-Cap 5 is in place. The top-seal 5L is shown but when the Cork-Cap 5 closure is in use, this top-seal 5L is inserted into the orifice 25D of the bottle or container where it forms a tight seal.

FIG. 18 is an example and an embodiment showing what a Cork-Cap 5 closure looks like.

FIG. 19 is an example and an embodiment of a cap-body 5A with a closed-opening 5K.

Figure 20:
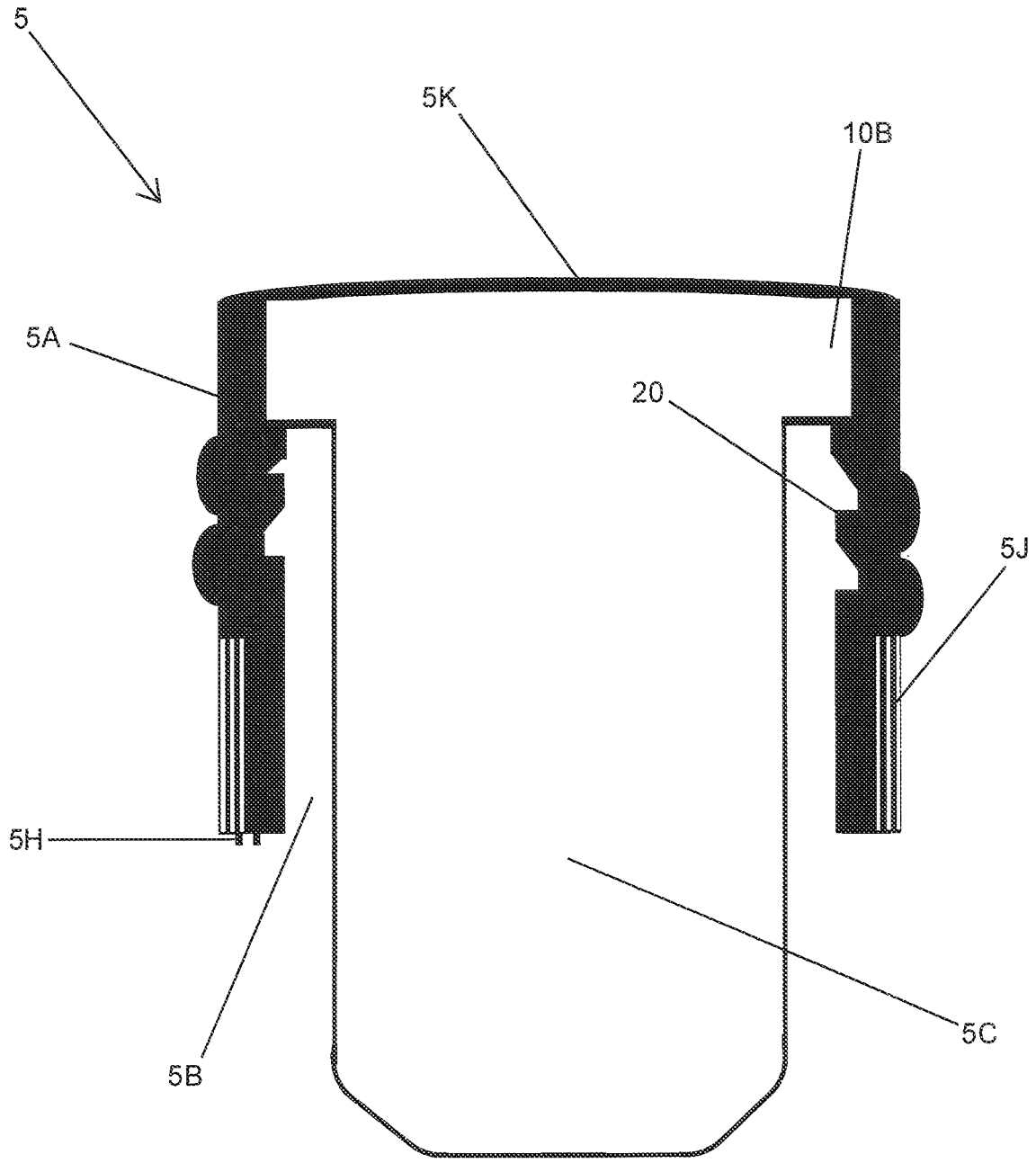
FIG. 20 is a view of a Cork-Cap 5, cap-body 5A, neck-cap space 5B, cork-body 5C, tamper-evident bridges 5H, knurl 5J, closed-end 5K, cork-ring 10B and continuous-threads 20.

FIG. 20 is an example and an embodiment of a Cork-Cap 5 closure without a crown-opening 5D. In this illustration the Cork-Cap 5 closure is seen with a closed-opening 5K. The Cork-Cap 5 with the closed-opening 5K and the Cork-Cap 5 with the crown-opening 5D are the same in every way except: one has a crown-opening 5D, see FIG. 4, and the other one has a closed-opening 5K, see FIG. 20. Let it be known that there are Cork-Cap 5 FIGS with crown-openings 5D and there are FIGS with closed-openings 5K.

Explanation: The Unitary Coupling Assembly Closure (UCAC) and Cork-Cap 5 are two names that are used interchangeably. Let it be known that artificial or man-made substitutes can be substituted in place of natural cork 5E. The Cork-Cap 5, see FIGS. 4, 5A, 6, 8, 10, 12, 17, 18 and 20 are the results of the assembling and coupling together of cap-bodies 5A, see FIG. 2, and the different types of corks 5E.

The cap-body 5A has two different types of cylindrical hollow like tubes: one cap-body 5A has an opening at both ends; the opening at the top end is the crown-opening 5D, see FIGS. 2 and 4, and the opening at the bottom end is the mouth 5F opening, see FIGS. 10 and 12. The other type of cap-body 5A has an opening at the bottom end and this is the mouth 5F opening, see FIGS. 10 and 12 and the top section has the closed-opening 5K, see FIGS. 10, 19 and 20, this area is not opened. The inside area of the cap-body 5A is the cap-body cavity 25E, this is the area where the cork 5E, or cork substitute is assembled and coupled to the cap-body 5A, see FIGS. 4, 8, 10, 12, 17 and 20. The cap-body 5A comes with and without continuous-threads 20, if it has continuous-threads 20, then it's a screw-on screw-off closure; if its without continuous-threads 20, then it's a twist and pull-out or push-in closure.

The cork 5E is viewed as having a cork-head 10, a cork-ring 10B, a top-seal 5L, a cork-body 5C and a cork-tip 10A, see FIG. 1. Once the cork 5E and the cap-body 5A are coupler together, see FIGS. 4, 5A, 8, 10, 12, 17, 18 and 20, this assembled coupling results in the formation of a Cork-Cap 5.

The cork-tip 10A of a cork 5E is slightly smaller than the cork-body 5C itself, it is used as a guide for corking or recorking. The cork-head 10 as well as the cork-head extension 10E are the top section of a corks 5E, see FIGS. 1, 4, 8, 9, 10, and 18, all cork-heads 10 except for the ones with the closed-openings 5K, are exposed to the atmosphere so that small, controlled amounts of oxygen carrying air can circulate in and out of a bottle or container; some of the artificial and man-made cork substitutes may or may not have this feature. All the cork-rings 108 have a cork-head 10, the underside of the cork-rings 10B come with several different cork-sealing surface 10C configurations, see FIGS. 13A, 13B, 14A, 14B, 15A, 15B, 16A and 16B. When a Cork-Cap 5 is employed, the cork-sealing surface 10C fits over a container or bottle-sealing surface 25B where it forms a seal, see FIGS. 4 and 8. The area within the cork-sealing surface 10C is the cork-ring center 10G, see FIGS. 13A, 14A, 14B, 15A, 15B, 16A and 16B, when this center is elongated, it forms a cork-body 5C, see FIGS. 1, 4, 17, 18 and 20. When the cork-ring center 10G is not elongated, it forms a disk like structure, see FIGS. 11, 12, 13B, 14B, 15B and 16B. It is the cork-body 5C that gets inserted into the orifice 25D and then inside the bottleneck 25 of a bottle or container doing corking and recorking, see FIGS. 4 and 8.

The Cork-Cap 5 offers the consumer a new and innovative alternative to an age-old problem of not being able to uncork a bottle when there is no uncorking device present. The Cork-Cap 5 offers the consumer the same ease and simplicity as that of using a screw cap when opening a bottle or container. All that is required when opening a bottle or container is the removing of the Cork-Cap 5. Let it be known that the features of the Cork-Cap 5 consist of but not limiting it in any way are the screw-ons with the continuous-threads 20, the push-ons without the continuous-threads 20, the crown-openings 5D, the closed-openings 5K, the different variations of cork-rings 10B and the different variations of cork 5E including cork substitutes.

The Unitary Coupling Assembly Closure 5 consist of but not limiting to the embodiment of its parts. Let it be known that this description is set forth so that an understanding of my invention can be obtained and none of this information should be interpreted as limiting my invention in any way. The advantages of the embodiment include, and without limitations that this invention is easy to implement and operate, and that it is cost effective and user friendly. The descriptions are to be considered for illustrative purposes and not restrictive in character in any way.

The top-cap rim 15 is present on all the Cork-Caps 5 that have a crown-opening 5D; the top-cap rim 15 adds a downward pressure on the cork-head 10, when the Cork-Cap 5 is in use, causing the cork-sealing surface 10C of the cork 5E to form an even tighter seal with the sealing surface of the bottle or container that it is being used on. The top-cap rim 15 is also instrumental in the coupling of the cork 5E to the cap-body 5A All the Cork-Caps 5 that have portions of cork 5E inserted into the orifice 25D of a bottle or container have a top-seal 5L, this is a section on the cork 5E that forms an even tighter seal just inside the orifice 25D of the bottle or container that it is inserted into.

What is claimed is:

1. A unitary coupling assembly closure comprising: a cap body and a natural cork; wherein the cap body comprises a cap body sidewall with an inner sidewall surface and an outer sidewall surface, the inner sidewall surface comprising threads; wherein the natural cork further comprises a cork body and a cork head which, the cork body extends within a container mouth and the cork head extends over a container lip forming a cork sealing groove; wherein the cork sealing groove between the cork body and the cork head includes a curved top seal; wherein the cap body inner sidewall surface is attached to the cork head and extends below the cork head to attach to threads of the container; and wherein after initial opening, the closure is capable of screwing back onto the container.

* * * * *